United States Patent [19]

Kagemann

[11] Patent Number: 4,616,463

[45] Date of Patent: Oct. 14, 1986

[54] SUSPENDED CEILING

[76] Inventor: Heinz Kagemann, Am Heidekamp 7, D-3380 Goslar 1, Fed. Rep. of Germany

[21] Appl. No.: 675,962

[22] Filed: Nov. 28, 1984

[30] Foreign Application Priority Data

Dec. 1, 1983 [DE] Fed. Rep. of Germany ..... 3343468

[51] Int. Cl.[4] ..... E04B 5/52

[52] U.S. Cl. ..... 52/665; 52/484

[58] Field of Search ..... 52/665, 484

[56] References Cited

U.S. PATENT DOCUMENTS

| | | | |
|---|---|---|---|
| 3,013,644 | 12/1961 | Smith | 52/665 X |
| 3,797,192 | 3/1974 | DeJonge | 52/665 |
| 4,338,755 | 7/1982 | Chichester, Jr. . | |

FOREIGN PATENT DOCUMENTS

| | | | |
|---|---|---|---|
| 0002432 | 7/1978 | European Pat. Off. . | |
| 0144074 | 11/1984 | European Pat. Off. . | |
| 6910483 | 3/1969 | Fed. Rep. of Germany . | |
| 6945570 | 11/1969 | Fed. Rep. of Germany . | |
| 2331413 | 1/1975 | Fed. Rep. of Germany . | |
| 2527704 | 12/1976 | Fed. Rep. of Germany | 52/665 |
| 2910967A1 | 10/1980 | Fed. Rep. of Germany . | |
| 2930273 | 2/1981 | Fed. Rep. of Germany . | |
| 3024745 | 7/1981 | Fed. Rep. of Germany | 52/665 |
| 3038020A1 | 4/1982 | Fed. Rep. of Germany . | |
| 1472180 | 1/1967 | France . | |
| 7213289 | 4/1974 | Netherlands . | |
| 1434249 | 5/1976 | United Kingdom | 52/665 |

*Primary Examiner*—J. Karl Bell

*Attorney, Agent, or Firm*—Karl F. Ross; Herbert Dubno

[57] ABSTRACT

The ceiling disclosed herein is a dropped ceiling which is formed of crossing and edgewise positioned crosspiece elements, which engage one another, for example, by a cross-lap or similar joint, at the crossing locations with corresponding apertures which, respectively, extend in opposing sense and over approximately half the height of the respective crosspiece elements. The crosspiece elements are formed as hollow chamber profiles of a plastic/synthetic material, and the chambers extend in the longitudinal direction of the elements. At least the top edge of each crosspiece element is slotted in the central plane. The slots can be separate slots arranged in series, or one continuous slot can be provided. The slots serve to enable insertion, in the manner of either hooks or snap locks or snap fasteners, of the adapters or attachment elements of bridging members, support or carrying members, or cover plates, into the respective upper chambers of the crosspiece elements.

12 Claims, 11 Drawing Figures

14
13b
13c
13b
13c
4
4
4
4
4
4
5
5
2
2
2
2
1
1
1
1
III
III
VIII
V

IVa
IVa
11
12
10
12

11
12
10
6b
6a
6a
6a
6
15

7
9
8
6b
6a
6a
6a
6
15

VII
VI
VI
VII
1
2
13

13a
13b
13c
6b
6a
6

13a
13b
13c
2
13c
13b
6b
1

SUSPENDED CEILING

FIELD OF THE INVENTION

My present invention relates to a suspended ceiling and more particularly, to removable or detachable dropped ceilings, or similar ceiling assemblies, and to pertaining ceiling components such as moldings, runners, and like hardware. Still more particularly, the present invention relates to a suspended ceiling composed of crossing or similarly intersecting crosspiece elements wherein the crosspiece elements are positioned in upright or similar edgewise attitude.

BACKGROUND OF THE INVENTION

Generally a dropped ceiling has crosspiece elements connected at each intersection where they cross by means of grooves, slots, or similar apertures, which extend, respectively, in an opposing sense over approximately half the height of the crosspiece element at hand, and the apertures are spaced in conformity with the layout or grid spacing. When compared with the crosspiece dimensions, large areas are left free between crosspieces. The ceiling also includes suspender devices which can be moved along and in the crosspieces.

The known ceiling systems of this type are comprised of crosspiece elements which are made of strips of chipboard, or similar material which has a surface layer of plastic/synthetic material, and the apertures which serve to join the members at hand are usually furnished at some time after laminating the surface layer of the laminated members or strips.

Such removable ceilings with crosspieces are particularly frequently used in exhibition halls and other similar commerical vending areas. They provide, in conjunction with the lighting arranged at the height of the ceiling, to an optical reduction of the pertaining room height. The region above the suspended ceiling can remain in substantially unfinished condition and may merely be provided with a coating of dark paint so as to be relatively invisible and not to interfere with the general appearance of the room.

The known ceilings are relatively heavy due to being manufactured of chipboard, and they require sturdy suspender or support devices, or a plurality of closely spaced support devices. Such devices are normally composed of two wires or rods, with one being connected to a crosspiece and the other being connected at the ceiling of the structure, and the overlapping ends are held in resilient clamping elements, which elements assist with alignment of the dropped ceiling and adjustment of the crosspiece elements.

For connecting the rods or wires to the crosspiece elements, there are provided grooves, apertures or similar openings in the upper—when in mounted or suspended condition—sides of the crosspiece elements, and brackets which can slide in such grooves are provided in the grooves. The lower ends of the rods or wires of the suspender devices are connected to these brackets.

For safeguarding the relative positions of the crosspiece elements at the intersections where the elements cross, the crosspiece elements are fixed by clamps which are driven into the sides which face in upward direction when the ceiling has been taken down. When arranging such ceilings near the entrance region of sales areas, or the like, an additional optically appealing cover is often desired for the ceiling areas which are embraced by crosspieces. Such covers may include foils or cover plates, and these covers, again, are secured at the crosspieces by means of clamps.

The known ceilings of this type have a substantial disadvantage due to the high risk of crosspieces breaking, particularly at the apertures which take up approximately one-half of the height of a crosspiece and which of necessity are required at the crossings. When mounting or assembling such ceilings, it can normally not be prevented that particularly lengthy crosspieces are broken and rendered useless. On the other hand, longer crosspieces are highly desirable because such ceilings are required for large rooms or halls, and when it is desired to produce a ceiling with relatively few visible abutting locations.

Special problems arise when such ceilings are taken down again and when they are suspended or hung again, either for reasons of adjusting the height in the same location or due to relocation of the ceiling somewhere else, which is frequently the case in exhibition and trade fair halls. When taking down the known ceilings, it is in practice generally not possible to take these down and suspend them at a new location without causing damage. Loosening of the clamps for the crosspieces at the crossings, as well as at any connecting portions between the covers and areas free of covers, is also not feasible without causing damage. In addition, the danger arises that on detachment or similar pulling apart of the securely connected crosspiece elements, breakage occurs, even with only minor tilting or skewing, or the surface coatings are visibly damaged.

OBJECTS OF THE INVENTION

It is, therefore, a general object of the invention to provide an improved ceiling of the type described in the foregoing which is of lightweight and highly resistant to breaking.

It is also an object of the invention to provide a ceiling in which the crosspiece elements have highly resistant surfaces.

It is further an object of the invention to provide an improved ceiling assembly which is easily assembled or mounted, as well as being easily taken down.

It is further an object of the invention to provide a ceiling structure which can be reused without problems.

SUMMARY OF THE INVENTION

In accordance with one aspect of the present invention these objects are attained in that the ceiling includes crosspiece elements which are formed as hollow chamber profiles made of plastic/synthetic material, and in which the chambers extend in the longitudinal direction of a crosspiece element. At least one of the two upper sides of the crosspiece elements is at least in part furnished with a slot or slots in which adapter or similar form parts can be secured in snap lock fashion, or a similar hooking manner, in the pertaining receiving chamber. The adapters can form part of supporting elements, carrying members, assembly plates, cover plates, or the like ceiling components.

Use of crosspiece elements which are formed as hollow chamber profiles, made of plastic/synthetic material, and furnished with chambers extending in the longitudinal direction provides very light structural parts. On the other hand, because of this profile configuration, the elements exhibit a high stability as to shape and high resistance to breaking. This applies even then when they are furnished, as is known, at predetermined and respective grid distances with apertures for the interlocking joining of the crosspiece elements at the crossing points. Arrangement of slots or similar openings in at least one of the upper sides and extending in the longitudinal direction, allows inserting and retaining of correspondingly shaped adapter parts in resilient and/or catch or snap lock manner. The adapters can be operatively connected to the support or carrying parts of the suspender devices or, alternatively, to cover plates. With a corresponding configuration of the adapters, which can engage the crosspiece elements in snap lock or hooking manner, it will be without difficulties possible to remove them from pertaining crosspiece elements during disassembly for repeated use and assembly of the ceiling at a new location.

The aforementioned slot or slots may be provided in only one upper side or end of respective crosspiece elements, and in such a way that the slotted side of each crosspiece element points in upward direction, when viewed in the detached condition of the ceiling. Because the adapters of the suspension or suspender device engage from above into the individual crosspieces, the suspender devices, such as, for example, rods or wires, are less noticeable in appearance than is the case with prior art grid ceilings. The ceiling in accordance with the invention does not require profiled lateral walls for associated clamps to be movably retained in such profile grooves, which grooves, in addition to their inherent technical effort, detract due to their visible exposure.

When arranging slots in both upper sides of the individual crosspiece elements, the opportunity is provided to additionally use the downwardly directed slots, when viewed when the ceiling has been taken down, for mounting or other securement of support elements or similar carrying devices. For example, into these slots there may be inserted hooks, catch or form parts, such as hangers and the like, for hanging attachment of direction signs and price signs, and the like. By means of these slots it is also possible to effect covering lower fields with plates or tarps, in conjunction with the mentioned adapters which engage in the slots.

The slots may be sequentially arranged in those sides of crosspiece elements which are directed upwardly in the installed position of the ceiling. The width of a slot is smaller than the width of a crosspiece, such that alongside the crosspieces there remain upwardly directed wall surfaces, which in the case of the crosspieces milled into such walls serve as support surfaces for engagement of adapter parts in hooking manner or in the fashion of a snap lock or fastener.

It is particularly preferred that at least one of the upper sides of the crosspiece elements is furnished with a continuous slot, and that the slot is bordered by longitudinal rims, walls, or similar projections which extend inwardly into the respective upper chamber of the chamber profile. These walls are generally extensions of the chamber-forming lateral walls and act as hoods for adapters or similar components. In such an embodiment of the crosspiece elements, the adapter parts engaged or mounted in the slot can be slid in any desired location in the upper side and can, furthermore, be slid along the extent of the slot. The inwardly directed longitudinal rims contribute to stabilization of the lateral walls of the pertaining chambers and, furthermore, act as spring elements for the adapters or form parts which can be slid into such slot or slots.

It is also preferred that the curved and inwardly directed longitudinal rims or edges of the upper chamber, chambers, or walls of the crosspiece elements extend parallel to the pertaining outer walls of the chambers and form with these recesses which open in the downward direction in the interior of upper chambers. In such embodiment, the wall portions which form such recesses and slots present a configuration which is generally U-shaped, when viewed in cross section. In the case of a continuous slot, such a configuration affords stabilization of the lateral walls of those chambers which are furnished with a slot or slots. Furthermore, such configuration gives the substantial advantage that the hook-like and inwardly directed longitudinal rims serve to leave a recess between them and the side walls of the pertaining chamber, for engagement or retention of hook-like or anchor-like adapters or form parts, for example, of suspenders or the like.

It is also preferred that the adapters or form parts which are secured at the crosspieces, are shaped in a manner similar to the head of a hammer and are held at a free end of a rod, flexible support member, or similar carrier or hanger. Such adapter configuration is suitable for all described slot embodiments in one or all of the upper sides of the carrying or crosspiece elements. The widths of the hammer head-shaped adapters is dimensioned approximately corresponding to the width of the slots, so that the adapters can be introduced without difficulty into those chambers which are furnished with slots, and by turning through 90° the adapters can be moved to attain the position corresponding to carrying, supporting or suspending the ceiling. Corresponding dimensioning or configuration of the hammer head enables a snap-like turning-in of the hammer head end into the slot so that the adapter can ultimately assume its support position.

For slots which are bordered by hook-like and inwardly directed longitudinal rims of the upper chamber walls, it is preferred that the adapters are shaped with projections which are either longitudinal or pin-like projections and these can engage the mentioned recesses, so as to fully fill the width of such recesses. It is also preferred that the rod or the flexible support member, at which an adapter is held is adapted to the width or clear slot cross section. There is then achieved an easily detached engagement between the adapter or form part and the crosspiece elements. The connection can be subjected to high loads, at the same time, however, this connection leads to stabilization of the shape of upper chambers which are furnished with a continuous slot.

For attaching load plates, support bars, or the like which can not make use of form parts with ends shaped like hammer heads, it is preferred to furnish these with heads having a mushroom-like configuration, for their engagement and securing in a manner similar to a snap lock in the upper chambers. Such form parts, which can be made unitary with the plates, crosspieces, or the like to be fastened and secured at the crosspiece elements of the ceiling, operate in the fashion of snap fasteners or snap locks and need to be adapted to the pertaining slot configurations.

For bilateral securement of the crosspiece elements at their crossing intersections it is also preferred that such intersections are covered by bridge components. These include a plate corresponding in size to the crosspiece width and include form parts which project from such plate. By being attachable in a manner similar to snap fasteners or snap locks, these bridge components are held on both sides of the intersection in the slot or slots of those crosspiece elements which are discontinuous at such intersections. Such bridge components can be readily removed, because they are also secured in accordance with snap fastener principles, without difficulty during disassembly, and can readily be used again when the ceiling is installed again, without damage being done at the bridge components or the crosspiece elements.

The aforementioned bridge components and the described form parts are preferably made of a plastic/synthetic material. It is further preferred that the crosspiece elements, the mentioned bridge components, and form parts are made of materials which exhibit a sufficient elastic deformability in order to achieve and/or utilize the desired resiliency or spring action which is required for the engagement and retention of such parts, which engagement and retention is similar to that of snap fasteners or snap locks.

The lateral or side walls of the crosspiece elements can be formed smooth or with a profile configuration as is customary. The crosspieces would normally be manufactured as extruded structures. When a smooth wall configuration is not desired, it is without difficulties possible, for example, to provide grooves or similar stiffening beads in these side walls of the crosspiece elements, which profiles can extend in longitudinal direction of the crosspiece elements.

BRIEF DESCRIPTION OF THE DRAWING

The above and other objects, features and advantages will become apparent from the following description, reference being made to the accompanying drawing in which.

SPECIFIC DESCRIPTION

Figures 1, 2, 8, 9:
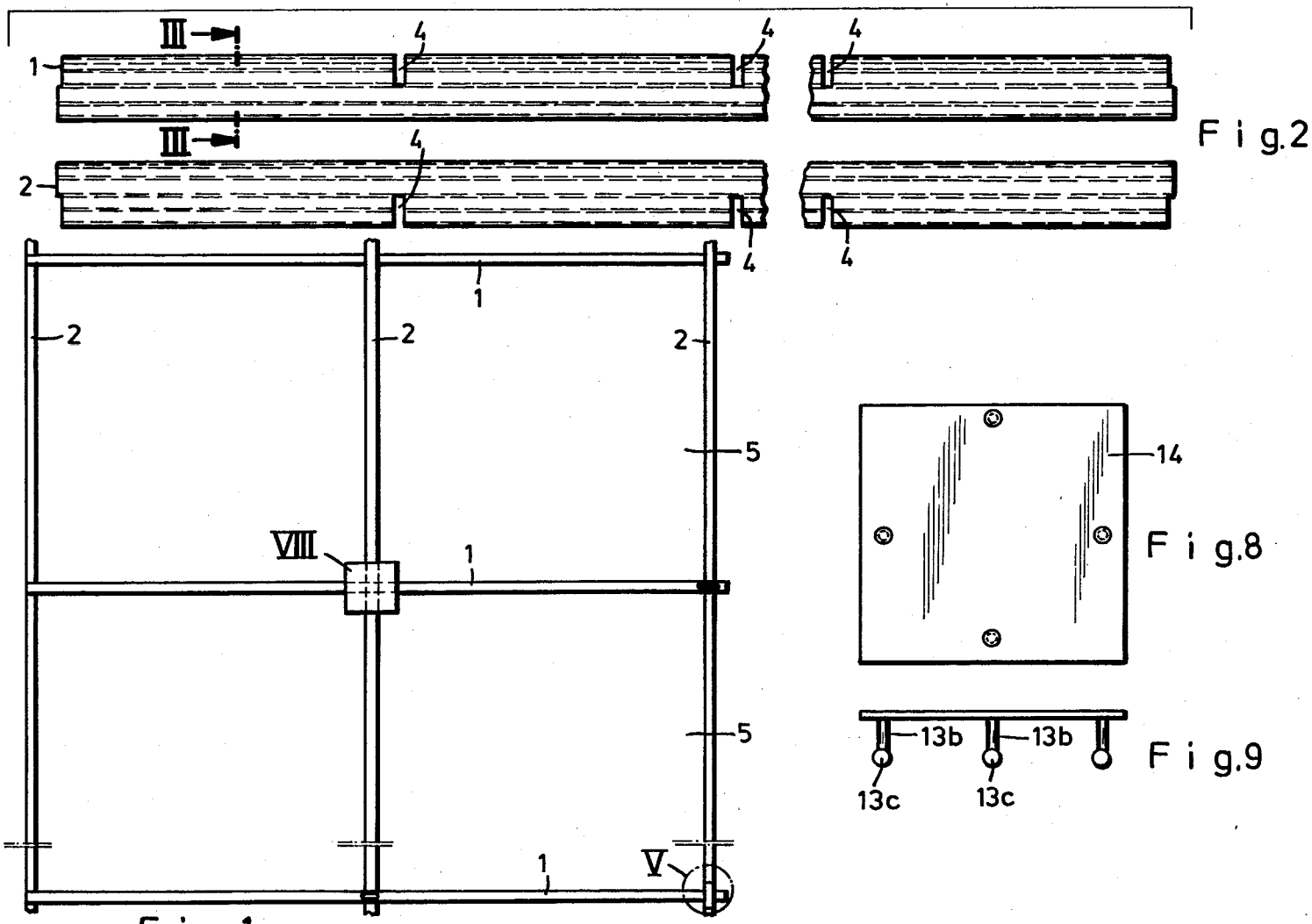
FIG. 1 is partial top plan view of a ceiling in accordance with one embodiment of the invention.
FIG. 2 is a side elevational view of two crosspiece elements with oppositely arranged openings for forming crossing locations.
FIG. 8 is a top plan view of the central crossing of two crosspiece elements at VIII in FIG. 1 drawn in a larger scale.
FIG. 9 is a side elevational view of the assembly of FIG. 8.

The partial top plan view of FIG. 1 of the grid ceiling, ceiling components or hardware, hereinafter referred to as ceiling, is comprised of first crosspiece elements 1 which extend in a first direction, i.e., horizontal in the drawing. The ceiling further comprises crosspiece elements 2 which extend in transverse direction with respect to crosspiece elements 1. The elements 1 and 2, of each of which respectively a side elevation is shown in FIG. 2, are furnished with apertures 4 which extend in opposite direction with respect to one another, approximately over half the height of each element, and at a distance corresponding to the pertaining layout or grid dimension of the ceiling. Elements 1 and 2 are joined at these apertures in the manner of a crosslap or similar joint.

In the embodiment shown in FIG. 1 the elements embrace square areas 5 which are free of elements and which areas are dimensioned much larger than pertaining dimensions of the elements 1 and 2.

Figures 3, 3A, 4, 4A, 5, 6, 7:
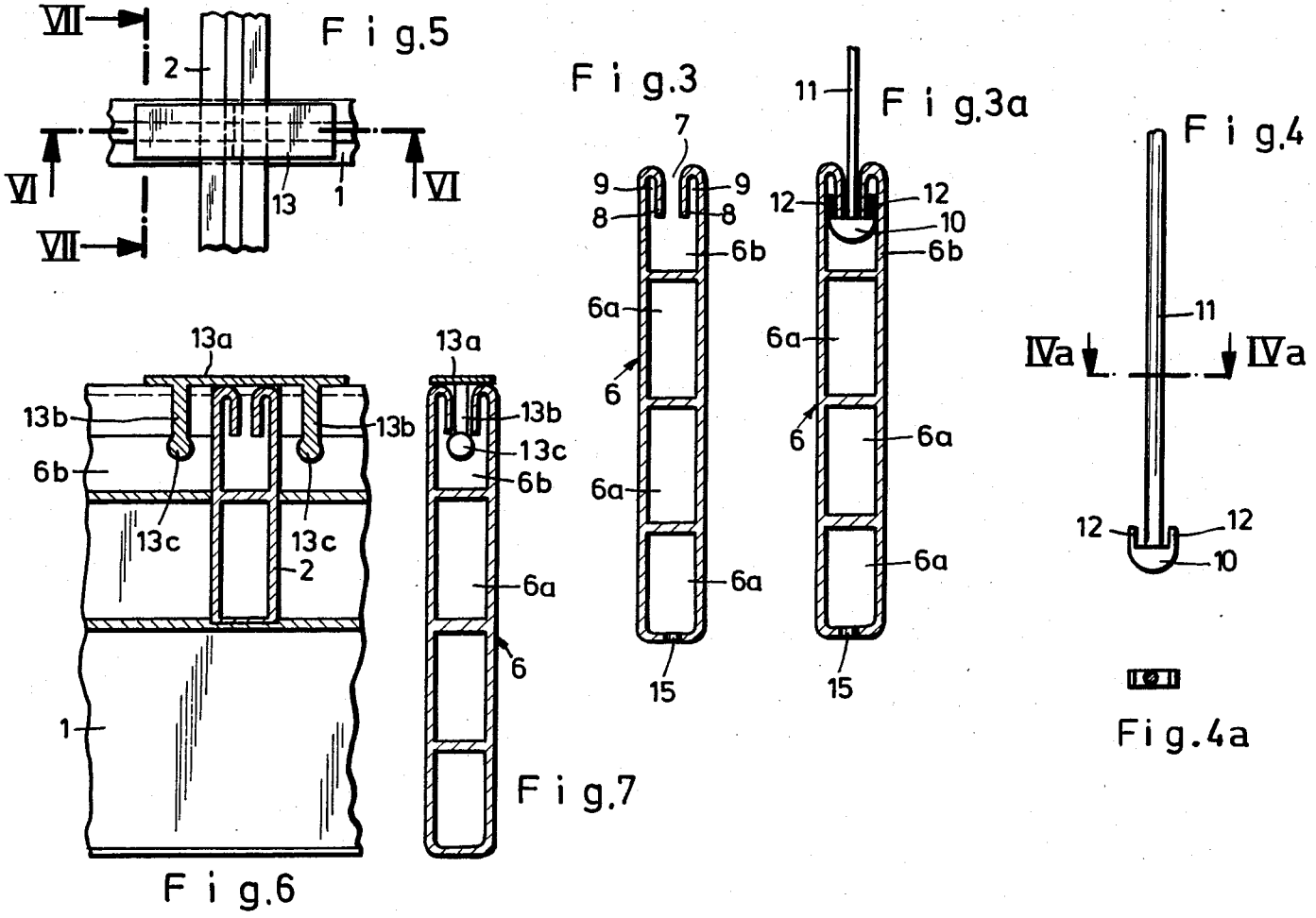
FIG. 3 is a cross section taken along line III—III in FIG. 2.
FIG. 3*a* is a sectional view similar to FIG. 3 with a suspension device.
FIG. 4 is a side elevational view of the suspension device of FIG. 3.
FIG. 4*a* is a cross section along line IV*a*—IV*a* in FIG. 4.
FIG. 5 is a top plan view of the corner of the ceiling with two intersecting crosspiece elements at V in FIG. 1 drawn in a larger scale.
FIG. 6 is a cross section along line VI—VI in FIG. 5.
FIG. 7 is a cross section along line VII—VII in FIG. 5.

The crosspiece elements 1 and 2 are provided with hollow chamber profiles, generally referred to as profiles and identified by reference numeral 6, as is particularly indicated in FIGS. 3 and 3*a*. These profiles 6 are furnished with hollow chambers 6*a* and 6*b* which extend in longitudinal direction, with three (two of 6*a* and one of 6*b*) being disposed above one another in vertical attitude. This attitude is generally referred to herein as edgewise or on-edge, whereby the uppermost surfaces of the elements 1 and 2 are referred to as upper sides or edges in the foregoing and in the following. The profiles 6 are formed of plastic/synthetic material and are extruded in repeating fashion with relatively large longitudinal dimensions. As is evident from FIGS. 3 and 3*a*, the upper chamber 6*b* is upwardly open by provision of a slot 7 which, in this embodiment, is provided by longitudinal rim portions 8 of the pertaining walls or sides of the profile 6, particularly the chamber 6*b*.

The slot 7 formed by the rim or wall portions 8 extends relatively deep into the upper chamber 6*b* and is formed by curved, hook, or bent portions of the inwardly and downwardly extending longitudinal rim, edge or wall portions 8 which in general extend parallel to the walls of the chamber 6*b*. Thus, between each portion 8 and the pertaining chamber wall there is provided a recess 9 which is open in downward direction.

The slot 7 is approximately positioned in the central vertical plane, and the slot 7 serves to receive, engage, and retain in the manner of a snap lock or snap fastener, form parts or adapters, for example, suspension or suspender devices, suspenders or other carriers, hangers or support members, as well as cover plates, assembly plates, and the like as required.

FIG. 3*a* shows an example of the arrangement of a suspension device which is mounted and held in the slot 7. The suspension device is provided by an adapter or form part 10 which is provided at the free bottom end of a rod or flexible support member 11. The form part 10, shown in detail in FIG. 4, is furnished with outwardly and upwardly oriented projections 12, which together can be compared to a hammer head, and these projections 12, in the hanging or pending attitude of the ceiling, engage in the recesses 9 of the hollow chamber profile 6, as is clearly indicated in FIG. 3*a*. Because of the hammer head configuration of the form part or adapter 10 which has a width which corresponds approximately to that of slot 7, the adapter 10 can be slid into the upper chamber 6*b* and upon rotation or turning through 90°, can be brought into operative and retentive engagement with its projections 12 in the recesses 9. The projections 12 are also longitudinal crosspieces. The dimensions of the rod or flexible support member 11 are selected such that the slot 7 is filled or closed by the support member, or rod, respectively. In this manner, with corresponding dimensioning of also the upwardly projecting crosspieces or projections 12, a positive engagement of such projections 12 in the recesses 9 is attained, so that the inwardly directed longitudinal edges or rims 8 are clamped between the mentioned projections 12 and the rod or flexible support member 11. Such a connection, engagement, or retention can be subjected to high stressing or loads without the danger of a deformation of the curved or inwardly bent longitudinal rims or edges 8 or the lateral walls of the upper receiving chamber 6*b*

The adapter 10 can be formed unitarily with the projections 12 and is preferably made of a plastic/synthetic material.

The configuration of a crossing or intersection of the two elements 1 and 2 is shown in FIGS. 5 to 7. FIG. 5 shows the region in the circle V in FIG. 1. The crosspiece elements 1 and 2 are joined at this location in a cross-lap or similar joint manner by way of the apertures or openings 4. The element 2 is furnished at this location at its lower side with an aperture 4, whereas the element 1 has an aperture 4 in the upper side, i.e., at that side which is furnished with the slot 7. The joint region is covered along the crosspiece element by a bridge component 13 which is composed of a plate 13*a* and retention parts, or form parts 13*b* formed on the plate and generally in unitary manner therewith. The retention parts 13*b* have a mushroom shape, or are similarly formed with heads 13*c* at their free ends, which heads allow engagement similar to that of a snap lock or snap fastener, in the upper chamber 6*b* of the pertaining hollow chamber profile 6, or the pertaining crosspiece element 1 or element 2 respectively.

Locking of mounting or assembly plates 14 at the elements 1 and 2 can be achieved in the manner similar to that employed in the securement of bridge component 13. The detail VIII of FIG. 1, which is shown in a larger scale in FIGS. 8 and 9, shows one mounting plate 14 which at its bottom side is furnished with parts similar to those of the bridge component 13. The retention parts 13*b*, which have heads 13*c* at their free ends, are clearly shown in FIGS. 8 and 9. The parts 13*b* are arranged at the plate 14 in such a way that they can be engaged like snap locks or snap fasteners in the longitudinal slots 7 of the elements 1 and 2 at the crossings thereof. The plate 14 can, for example, serve for attaching electrical installation elements, such as, for example electrical outlets or the like.

Instead of covering only one crossing, in a similar fashion also the entire free areas 5 between elements 1 and 2 may be covered or closed over a predetermined extent of the ceiling.

In yet another embodiment it will be possible to have slots 7 provide in both the upper and lower edges or sides of the two elements 1 and 2, so that also from below into such slots there can be introduced corresponding attachment components or similar carrying elements which are equipped with hooks or corresponding retention parts, for example, for mounting direction indicators, signs, cover plates, or the like.

In place of the described embodiment of slots 7 which are formed between downwardly and inwardly directed, longitudinal rims 8, so as to form hook-like members, it is also within the scope of this invention to provide only one opening or recess, as it is indicated in the lower part of FIGS. 3 and 3*a* at 15. Such slots, purely formed as openings 15, present, however, disruptions of the relative stability in the longitudinal extent of the elements 1 or 2, and, consequently, these could generally not be subjected to such loads as can be withstood in the embodiments with upper slots 7, as described above. The interruptions caused by the openings 15 also prevent mounting at any desired location of introduced suspension devices along the longitudinal extent of the elements 1 and 2 and prevents sliding of these along the elements; however, also in the case of openings 15, the retention of adapters or similar parts in a fashion of hooks, snap locks, or snap fasteners, is equally feasible, as described in the embodiments having a slot or slots 7.

It is clear from the foregoing that the various items such as support, carrying, or suspension parts or devices, suspenders, hangers and the like, may collectively be referred to as attachment members. Such attachment members, of course, can be furnished with adapters and similar form parts which can be inserted and retained in the openings, slots, and the like, in the pertaining chamber of a crosspiece element.

It is clear from the foregoing description of the presently preferred embodiments shown in the drawings, that the detachable ceiling is readily and easily mounted or installed. It can be taken down and disassembled with equal ease, and the crosspiece elements 1 and 2 can without hesitation be manufactured in generally larger units than has been the case with prior art elements.

Reference in this disclosure to details of the specific embodiments is not intended to restrict the scope of the appended claims, which themselves recite those features regarded as essential to the invention.

I claim:

1. A dropped ceiling, comprising:

a plurality of upper and a plurality of lower crosspiece elements having, respectively, top and bottom edges and being adapted to cooperatingly interact in crossing and edgewise position with respect to one another for forming a grid with open spaces which in comparison with the dimensions of said crosspiece elements are relatively large, said crosspiece elements including respective slot-like transverse apertures which extend in opposite senses in the two pluralities of said elements, in each case over approximately half the height of the associated crosspiece element and with adjacent ones of said apertures in each cross piece element disposed at a distance from each other corresponding to the desired grid dimension of the ceiling, so as to interconnect said elements by way of a crosslap or like joint;

each of said crosspiece elements having the structure of a hollow chamber profile made of synthetic plastic material, with each chamber extending in the longitudinal direction of the respective crosspiece element;

at least said top edge of each upper and lower crosspiece element being provided at least in part with at least one upwardly directed opening extending longitudinally of that element, the uppermost portion of each of the two lateral walls of each upper and lower crosspiece element that define the boundaries of the uppermost chamber of that crosspiece element being bent over and down into said uppermost chamber thereof in substantially parallel relation to each other and said walls to define between the two bent down wall portions a space constituting said at least one opening, and each bent down wall portion being spaced from the adjacent remainder of the same wall to define therebetween a respective downwardly open recess;

a plurality of attachment members adapted to be releasably interconnected with said upper crosspiece elements and to be moved along the latter, each attachment member including a suspension rod having a lower end and carrying at said lower end an adapter constructed for insertion into a respective opening of a respective crosspiece element, and said adapters being operable to coact with the downturned edges of the associated bent down wall portions to firmly suspend said upper crosspiece elements from said attachment members; and a plurality of bridge components each adapted to be located at a respective crossing region of an upper and a lower crosspiece element, each of said bridge components including a plate which at least corresponds in width to the width of the lower crosspiece element and has at least two projecting parts depending therefrom, each projecting part having a narrow portion carried by said plate and a wide portion carried by said narrow portion, and the thickness of each of said narrow portions being somewhat less and the thickness of each of said wide portions being somewhat greater than the width of said at least one opening between said bent down wall portions of said lower crosspiece element, whereby with said bridge components being disposed across the respective crossing regions of said upper and said lower crosspiece elements, transversely of and above the former and longitudinal of and above the latter, said wide portions of the associated projecting parts can be inserted into the respective openings of said lower crosspiece elements with a snap fit to underlie the lowermost edges of the associated bent down wall portions and firmly secure said lower crosspiece elements to said upper crosspiece elements.

2. A ceiling according to claim 1 wherein in at least one of said top and bottom edges of at least one crosspiece element said bent down wall portions are substantially coextensive with the longitudinal dimension of the crosspiece element to define an opening in the form of a continuous slot extending from one end of that crosspiece element to the other.

3. A ceiling according to claim 1 wherein said adapter of at least one of said attachment members has a body shaped generally in a hammer head manner relative to the associated suspension rod, said body having at its opposite ends a pair of parallel upstanding projections the thickness of each of which is slightly less than the width of each of said downwardly open recesses, the length of said body being somewhat greater than the width of said at least one opening between said bent down wall portions and slightly less than the width of said uppermost chamber between said walls, and the width of said body and the thickness of said suspension rod each being slightly less than the width of said at at least one opening between said bent down wall portions, whereby said adapter, upon said body thereof being oriented longitudinally of an upper crosspiece element, can be inserted into said uppermost chamber of that upper crosspiece element through the respective opening and then, upon said body being rotated through 90° and oriented transversely of that upper crosspiece element, can be manipulated to dispose said projections each securely in and substantially filling a respective one of said recesses.

4. A ceiling according to claim 1 wherein said bottom edge of each of said upper and lower crosspiece elements is provided with at least one additional downwardly directed opening for receiving an attachment element of an indicator, sign, cover plate, or the like to enable the same to be suspended from an associated crosspiece element.

5. A ceiling according to claim 4 wherein said at least one additional opening in at least one of said crosspiece elements extends longitudinally of its respective crosspiece element, the lowermost portion of each of the two lateral walls of said respective crosspiece element that define the boundaries of the lowermost chamber of that crosspiece element is bent over and up into said lowermost chamber thereof in substantially parallel relation to each other and said walls to define between the two bent up wall portions a space constituting said at least one additional opening, with each bent up wall portion being spaced from the adjacent remainder of the same wall to define therebetween a respective upwardly open recess, and each said attachment element is constructed for insertion into said at least one additional opening and is operable to coact with the upturned edges of the associated bent up wall portions to rest firmly thereon for suspending the respective indicator, sign, cover plate, or the like from the associated crosspiece element.

6. A ceiling according to claim 5 wherein each said attachment element includes a wide portion the thickness of which is somewhat greater than the width of said at least one additional opening between said bent up wall portions of said associated crosspiece element to enable the attachment element to be inserted into the respective additional opening with a snap fit to overlie the uppermost edges of the associated bent up wall portions.

7. A ceiling according to claim 5 wherein each said attachment element has a body shaped generally in a hammer head manner relative to an associated suspension element, said body having at its opposite ends a pair of parallel downward projections the thickness of each of which is slightly less than the width of each of said upwardly open recesses, the length of said body being somewhat greater than the width of said at least one additional opening between said bent up wall portions and slightly less than the width of said lowermost chamber between said walls, and the width of said body and the thickness of said suspension element each being slightly less than the width of said at least one additional opening between said bent up wall portions, whereby said attachment element, upon said body thereof being oriented longitudinally of an associated crosspiece element, can be inserted into said lowermost chamber of that crosspiece element through the respective additional opening and then, upon said body being rotated through 90° and oriented transversely of that crosspiece element, can be manipulated to dispose said downward projections each securely in and substantially filling a respective one of said upwardly open recesses.

8. A dropped ceiling, comprising:

a plurality of upper and a plurality of lower crosspiece elements having, respectively, top and bottom edges and being adapted to cooperatingly interact in crossing and edgewise position with respect to one another for forming a grid with spaces which in comparison with the dimensions of said crosspiece elements are relatively large, said crosspiece elements including respective slot-like transverse apertures which extend in opposite senses in the two pluralities of said elements, in each case over approximately half the height of the associated crosspiece element and with adjacent ones of said apertures in each crosspiece element disposed at a distance from each other corresponding to the desired grid dimension of the ceiling, so as to interconnect said elements by way of a crosslap or like joint;

each of said crosspiece elements having the structure of a hollow chamber profile made of synthetic plastic material, with each chamber extending in the longitudinal direction of the respective crosspiece element;

at least said top edge of each upper and lower crosspiece element being provided at least in part with at least one upwardly directed opening extending longitudinally of that element, the uppermost portion of each of the two lateral walls of each upper and lower crosspiece element that define the boundaries of the uppermost chamber of that crosspiece element being bent over and down into said uppermost chamber thereof in substantially parallel relation to each other and said walls to define between the two bent down wall portions a space constituting said at least one opening, and each bent down wall portion being spaced from the adjacent remainder of the same wall to define therebetween a respective downwardly open recess;

a plurality of attachment members adapted to be releasably interconnected with said upper crosspiece elements and to be moved along the latter, each attachment member including a suspension rod having a lower end and carrying an adapter at said lower end, said adapter of at least one of said attachment members haing a body shaped generally in a hammer head manner relative to the associated suspension rod, said body having at its opposite ends a pair of parallel upstanding projections the thickness of each of which is slightly less than the width of each of said downwardly open recesses, the length of said body being somewhat greater than the width of said at least one opening between said bent down wall portions and slightly less than the width of said uppermost chamber between said walls, and the width of said body and the thickness of said suspension rod each being slightly less than the width of said at least one opening between said bent down wall portions, whereby said adapter, upon said body thereof being oriented longitudinally of an upper crosspiece element, can be inserted into said uppermost chamber of that upper crosspiece element through the respective opening and then, upon said body being rotated through 90° and oriented transversely of the upper crosspiece element, can be manipulated to dispose said projections each securely in and substantially filling a respective one of said downwardly open recesses; and a plurality of bridge components each adapted to be located at a respective crossing region of an upper and a lower crosspiece element transversely of and above the former and longitudinally of and above the latter and having means for securing the respective bridge component to that lower crosspiece element, thereby to suspend said lower crosspiece elements from said upper crosspiece elements.

9. A ceiling according to claim 8 wherein said bottom edge of at least one of said upper and lower crosspiece elements is provided with at least one additional downwardly directed opening for receiving an attachment element of an indicator, sign, cover plate, or the like to enable the same to be suspended fom an associated crosspiece element.

10. A ceiling according to claim 9 wherein said at least one additional opening in at least one of said crosspiece elements extends longitudinally of its respective crosspiece element, the lowermost portion of each of the two lateral walls of said respective crosspiece element that define the boundaries of the lowermost chamber of that crosspiece element is bent over and up into said lowermost chamber thereof in substantially parallel relation to each other and said walls to define between the two bent up wall portions a space constituting said at least one additional opening, with each bent up wall portion being spaced from the adjacent remainder of the same wall to define therebetween a respective upwardly open recess, and each said attachment element is constructed for insertion into said at least one additional opening and is operable to coact with the upturned edges of the associated bent up wall portions to rest firmly thereon for suspending the respective indicator, sign, cover plate or the like from the associated crosspiece element.

11. A ceiling according to claim 10 wherein each said attachment element includes a wide portion the thickness of which is somewhat greater than the width of said at least one additional opening between said bent up wall portions of said associated crosspiece element to enable the attachment element to be inserted into the respective additional opening with a snap fit to overlie the uppermost edges of the associated bent up wall portions.

12. A ceiling according to claim 10 wherein each said attachment element has a body shaped generally in a hammer head manner relative to an associated suspension element, said body having at its opposite ends a pair of parallel downward projections the thickness of each of which is slightly less than the width of each of said upwardly open recesses, the length of said body being somewhat greater than the width of said at least one additional opening between said bent up wall portions and slightly less than the width of said lowermost chamber between said walls, and the width of said body and the thickness of said suspension element each being slightly less than the width of said at least one additional opening between said bent up wall portions, whereby said attachment element, upon said body thereof being oriented longitudinally of an associated crosspiece element, can be inserted into said lowermost chamber of that crosspiece element through the respective additional opening and then, upon said body being rotated through 90° and oriented transversely of that crosspiece element, can be manipulated to dispose said downward projections each securely in and substantially filling a respective one of said upwardly open recesses.

* * * * *